US011285507B2

(12) United States Patent
Choi

(10) Patent No.: US 11,285,507 B2
(45) Date of Patent: Mar. 29, 2022

(54) DIP COATING APPARATUS FOR COATING MEDICAL ASSIST DEVICE

(71) Applicant: Noanix Corporation, Cheongju-si (KR)

(72) Inventor: Hyung Joon Choi, Cheongju-si (KR)

(73) Assignee: Noanix Corporation, Cheongju-si (KR)

( * ) Notice: Subject to any disclaimer, the term of this patent is extended or adjusted under 35 U.S.C. 154(b) by 0 days.

(21) Appl. No.: 17/080,136

(22) Filed: Oct. 26, 2020

(65) Prior Publication Data

US 2021/0220867 A1 Jul. 22, 2021

(30) Foreign Application Priority Data

Jan. 21, 2020 (KR) ..... 10-2020-0008038

(51) Int. Cl.
*B05C 13/02* (2006.01)
*B05C 3/10* (2006.01)

(52) U.S. Cl.
CPC ..... *B05C 13/02* (2013.01); *B05C 3/10* (2013.01)

(58) Field of Classification Search
None
See application file for complete search history.

(56) References Cited

U.S. PATENT DOCUMENTS

2006/0210699 A1* 9/2006 Collins ..... B05C 13/02 427/2.1
2007/0222132 A1* 9/2007 Anderson ..... B05C 3/09 269/37
2011/0014386 A1* 1/2011 Dillon ..... B05C 3/12 427/430.1
2019/0070630 A1* 3/2019 Surma ..... B05C 11/101

FOREIGN PATENT DOCUMENTS

CN 104307690 A 1/2015

* cited by examiner

*Primary Examiner* — Jethro M. Pence
(74) *Attorney, Agent, or Firm* — Knobbe Martens Olson & Bear LLP

(57) ABSTRACT

This application relates to a dip coating apparatus for coating a medical assist device such as a catheter or guidewire to a uniform thickness. The apparatus includes a casing and a coating booth disposed in the casing and containing a coating fluid. The apparatus also includes an elevating member vertically movable in the casing and configured to hold an upper end of each of medical assist devices so that the medical assist devices can be hung. The apparatus further includes a position adjusting member for adjusting the height of the elevating member, and a controller for controlling operation of the position adjusting member. The coating booth includes a coating unit having the same length as each medical assist device and a hopper-shaped guide unit that guides a bundle of the medical assist devices to be inserted into the coating unit when the guide unit contacts the medical assist devices.

10 Claims, 3 Drawing Sheets

DIP COATING APPARATUS FOR COATING MEDICAL ASSIST DEVICE

CROSS REFERENCE TO RELATED APPLICATION

The present application claims priority to Korean Patent Application No. 10-2020-0008038, filed Jan. 21, 2020, the entire contents of which is incorporated herein for all purposes by this reference.

BACKGROUND

1. Field

The present disclosure relates to a dip coating apparatus for coating a medical assist device. More particularly, the present disclosure relates to a dip coating apparatus for uniformly coating the surface of a long medical assist device such as a catheter or guidewire with a coating fluid.

2. Description of the Related Technology

Among medical devices, a catheter is a flexible medical tube for drawing a body fluid or for injecting a medication into a body cavity of a living organism.

A guidewire is a medical device for towing or moving a medical assist device along an organ or a blood vessel.

When performing a procedure of inserting a long medical device such as a catheter or guidewire into a blood vessel or organ, inflammation or injury may occur in the blood vessel or organ when the catheter or guidewire comes into direct contact with the wall of a blood vessel or mucous membrane of an organ.

Therefore, a catheter or guidewire is required to be coated with a hydrophilic material having a low wet frictional coefficient to prevent a blood vessel or mucous membrane from being injured by the catheter or guidewire.

Chinese Patent Application Publication No. 104307690 (Jan. 28, 2015) discloses the related technology.

The disclosure of this section is to provide background information relating to the invention. Applicant does not admit that any information contained in this section constitutes prior art.

SUMMARY

The present disclosure provides a dip coating apparatus for coating a medical assist device, the apparatus being capable of reducing the consumption of a coating fluid by using a coating tube, reducing manufacturing time by using a hopper-shaped coating booth that allows a bundle of medical assist devices to be coated at a time, and forming a uniform coating on the surface of a long medical assist device such as a catheter or guidewire.

One aspect of the present invention provides a dip coating apparatus for coating a medical assist device, the apparatus including: a casing defining an overall external form of the apparatus and providing an accommodation space; a coating booth provided in a lower portion of the accommodation space and configured to store a coating fluid; an elevating member provided in the accommodation space, configured to hold an upper end of each medical assist device such that the medical assist devices are hung thereon, and configured to move up and down the medical assist devices; a position adjusting member installed in the casing and configured to adjust a vertical position of the elevating member; and a controller controlling operation of the position adjusting member.

The coating booth may include: a coating unit having the same length as the medical assist device; and a hopper-shaped guide unit that guides a bundle of the medical assist devices to be inserted into the coating unit positioned in a center region when the guide unit comes into contact with the medical assist devices.

The apparatus may further include coating tubes between the coating booth and the elevation member, the coating tubes having the same length as the medical assist devices and being coated with a coating fluid on an inner surface thereof, thereby coating the respective medical assist devices when the respective medical assist devices pass therethrough.

Each of the coating tubes may be provided with an S-shaped trap that is bent in an S shape and temporarily stores the coating fluid so that the coating fluid can be coated on a corresponding one of the medical assist devices when the medical assist device passes therethrough.

The position adjusting member may include: a rail installed to vertically extend in the accommodation space; a guide member mounted on the elevating member in a manner to move along the rail; and an elevating motor provided on the elevating member and configured to move the guide member in a vertical direction.

The apparatus according to embodiments of the present invention described above can reduce the consumption of a coating fluid by using a coating tube, can reduce manufacturing time by using a hopper-shaped coating booth that allows multiple medical assist devices to be coated as a bundle, and can uniformly coat a long medical assist device such as a catheter or guidewire from the leading end to the trailing end.

DETAILED DESCRIPTION OF EMBODIMENTS

Hereinafter, embodiments of the present invention will be described in detail with reference to the accompanying drawings so that those skilled in the art can easily carry out the present invention.

In an example of coating process for medical devices, catheters or guidewires are hung on jigs, then lowered to be dipped into a coating fluid contained in a box, and raised.

However, since catheters or guidewires are typically very long, it is difficult for the catheters or guidewires to be completely dipped into the coating fluid. In addition, a coating on a leading end portion of the catheter or guidewire may be thicker than a coating on a trailing end portion of the catheter or guidewire because the leading end portion that is dipped into the coating fluid earlier than the trailing end portion stays a longer time in the coating fluid than the trailing end portion.

Therefore, a dip coating apparatus capable of uniformly coating a medical assist device may be required.

Figure 1:
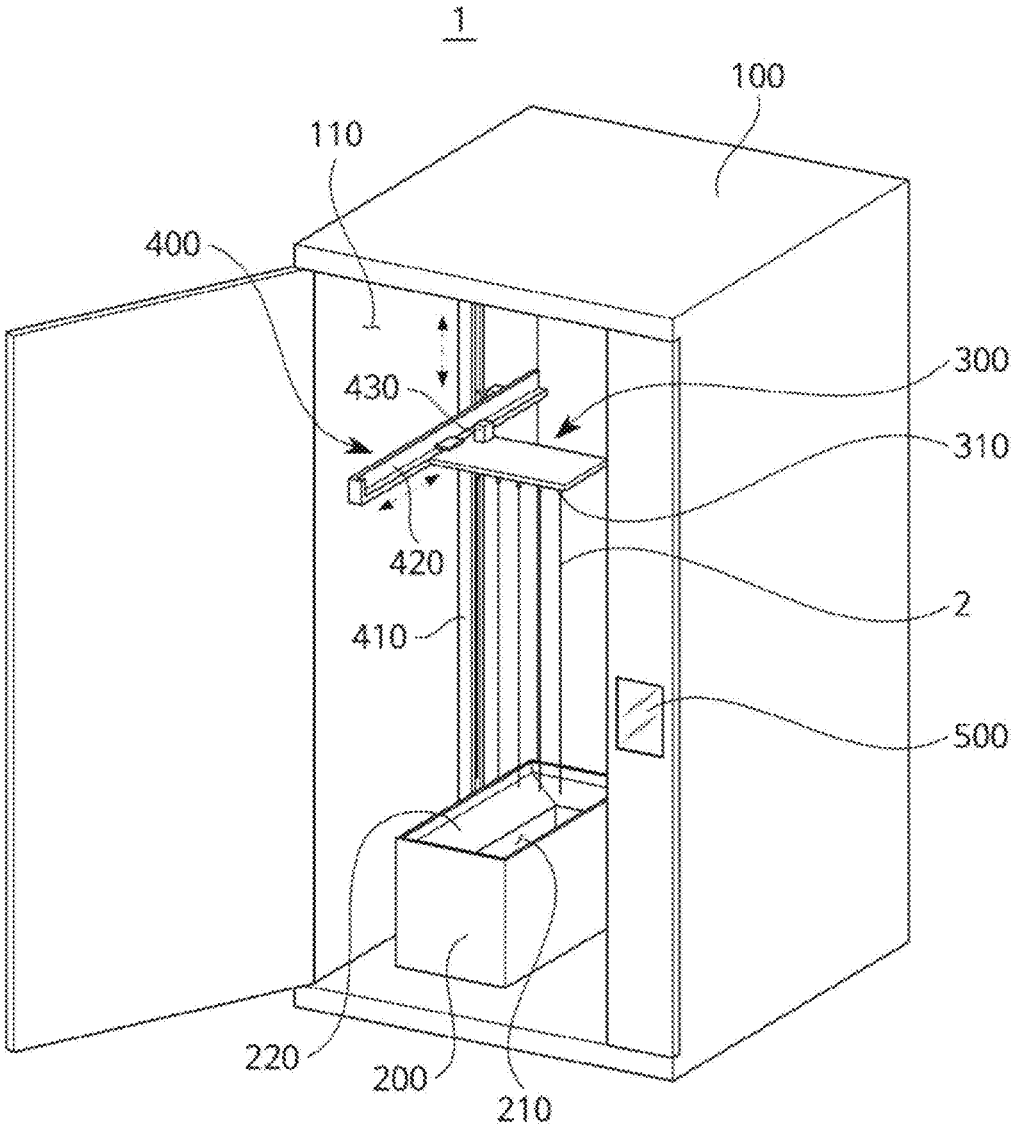
FIG. 1 is a diagram illustrating the construction of a dip coating apparatus according to one embodiment of the present invention.
Figure 2:
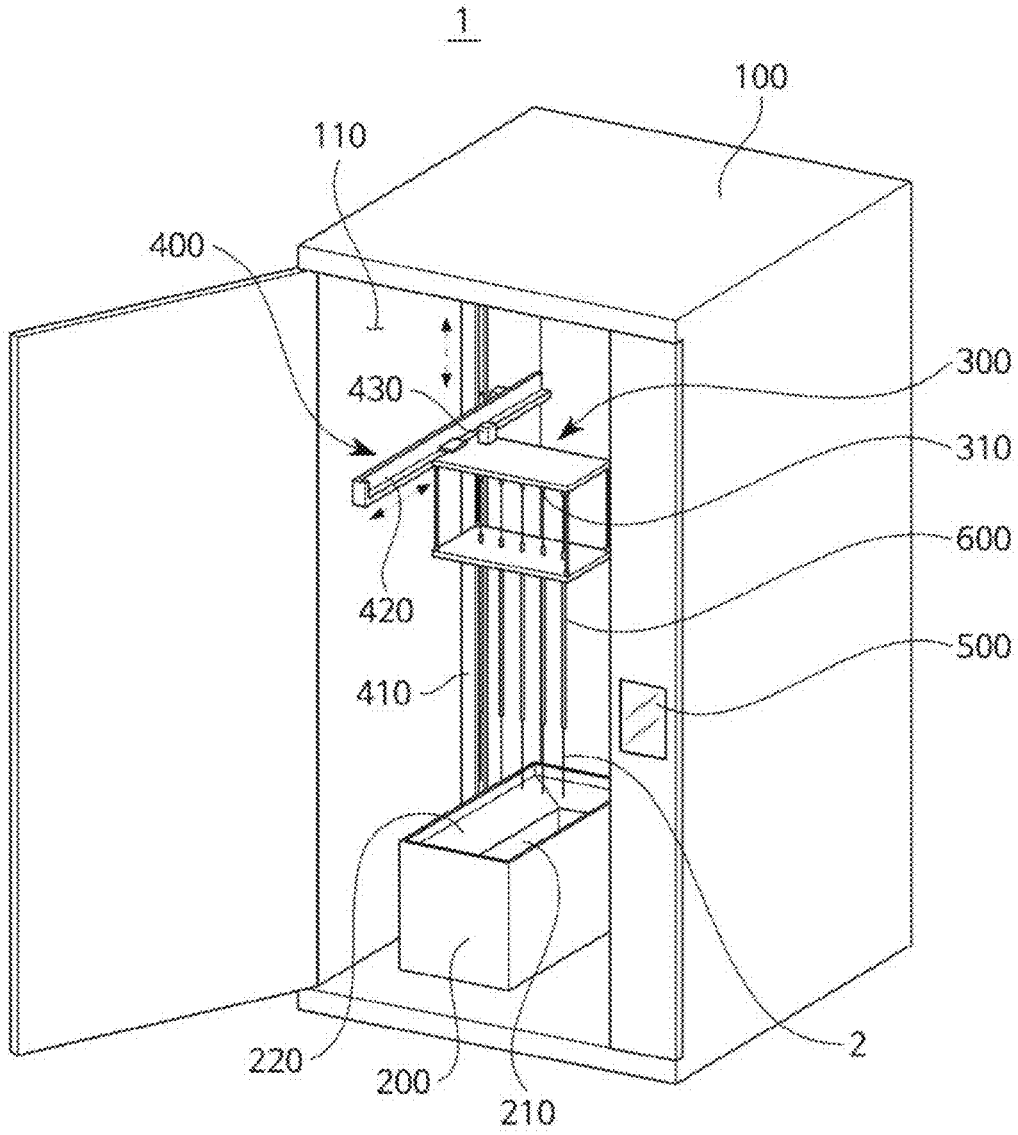
FIG. 2 is a diagram illustrating the construction of a dip coating apparatus equipped with coating tubes, according to a first embodiment of the present invention.
Figure 3:
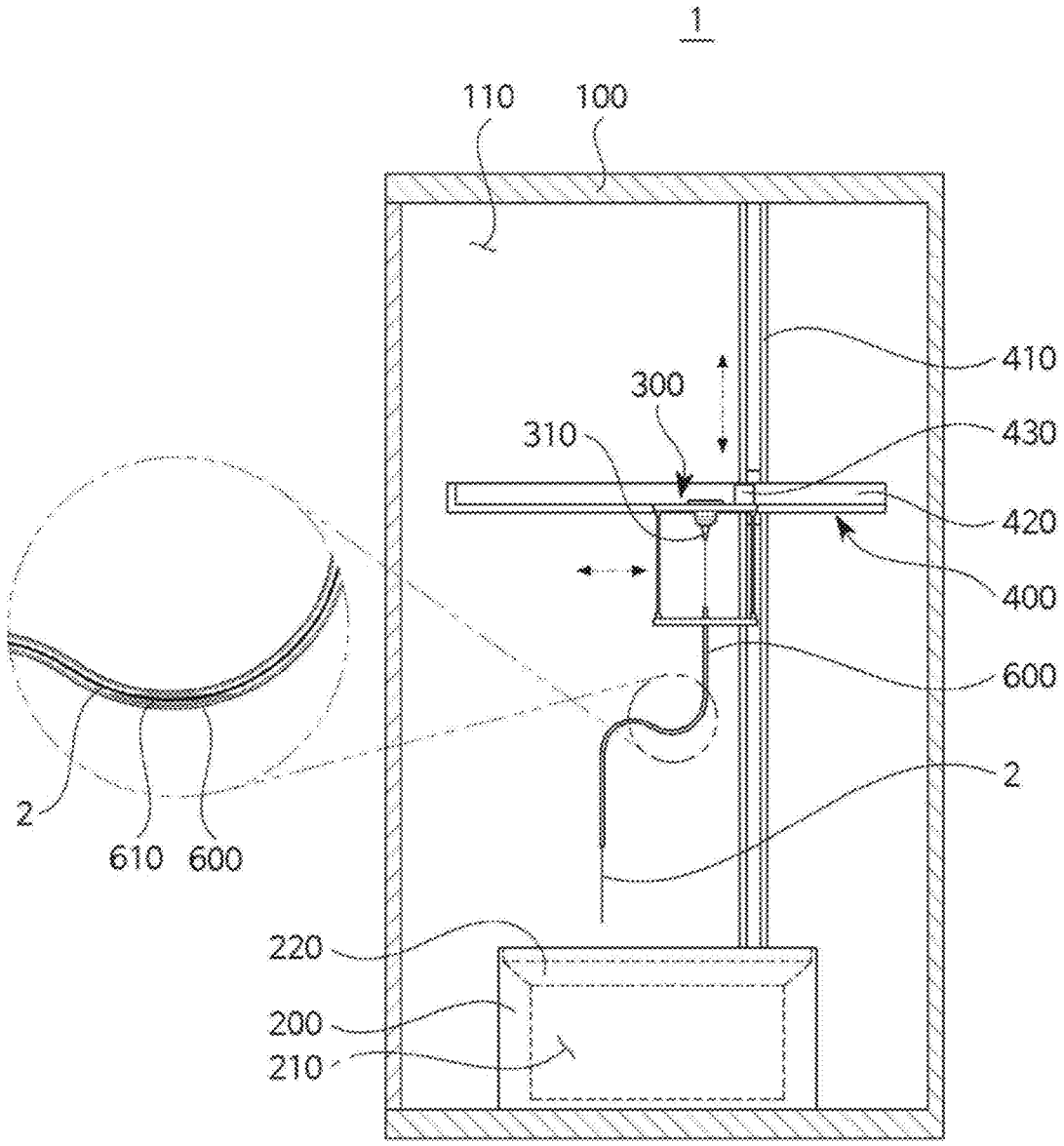
FIG. 3 is a diagram illustrating the construction of a dip coating apparatus equipped with coating tubes, according to a second embodiment of the present invention.

As illustrated in FIGS. 1 to 3, according to one embodiment of the present invention, a dip coating apparatus 1 for coating a medical assist device is an apparatus for coating a long medical assist device 2 such as a catheter or guidewire. The catheter is a medial tube for drawing a body fluid or for injecting a medication into a body cavity of a living organism. The guidewire is to tow or move a medical assist device along an organ or blood vessel.

The overall external form of the dip coating apparatus 1 is defined by a casing 100. An accommodation space 110 is formed in the casing 100.

The casing 100 has an overall cuboid shape, the inside of which is provided with the accommodation space 110. The front wall of the casing 100 is provided with a transparent door to allow the accommodation space to be visually checked from the outside of the casing case 100.

A coating booth 200 is provided in a lower portion of the accommodation space 110, and a coating fluid can be contained in the coating booth 200.

The coating booth 200 contains a coating fluid for coating the surface of the medical assist device 2. In embodiments, a plurality of coating booths 200 may be arranged in series as necessary.

In embodiments, the coating fluid is a hydrophilic coating fluid having a low wet frictional coefficient to prevent the organ of a human body from being injured or inflammatory by the rough surface of the medical assist device 2. Alternatively, the coating fluid may be a hydrophobic coating fluid which facilitates a coated medical assist device to be easily inserted into a blood vessel.

The coating booth 200 includes a viscosity adjuster that adjusts the viscosity of the coating fluid to control the thickness of a coating on the surface of the medical assist device 2.

The coating booth 200 includes a long coating unit 210 having the same length as the medical assist device 2 and a hopper-shaped guide unit 220 that tapers to the bottom and has a predetermined area. The guide unit 220 collectively guides multiple medical assist devices 2 as a bundle to be inserted into the coating unit 210 positioned in a center region when the medical assist devices 2 come into contact with the guide unit 220.

Specifically, when the scattered end portions of the respective medical assist devices 2 come into contact with the guide unit 220 due to the descending movement of an elevating member 300, the end portions of the respective medial assist devices 2 can be easily inserted into the coating unit 210 by being guided by the guide unit 200. Thus, the medical assist devices 2 densely gather as in a case of being bundled, and are dipped into the coating fluid contained in the coating unit 210.

An upper portion of the accommodation space 110 is provided with the elevating member 300 configured to an upper end portion of each of the multiple medical assist devices 2 so that the multiple medical assist devices 2 are hung on the elevating member 300. The elevating member 300 moves the medical assist devices 2 hung thereon up and down.

The elevating member 300 includes a plate equipped with a plurality of clamps 310 that can hold the upper end of each medical assist device 2. The plate has a predetermined width and is configured to move vertically and horizontally in the accommodation space 110.

The clamps 310 are arranged at regular intervals, and the medical assist devices 2 vertically extend from the respective clamps 310.

A position adjusting member 400 for adjusting the height of the elevating member 300 is installed in the accommodation space 110.

The position adjusting member 400 is installed to move the elevating member 300 in the vertical direction, and the position adjusting member 400 is controlled by a controller 500 which will be described below.

A rail 410 is vertically installed in the accommodation space 110. A guide member 420 is fixed to the elevating member 300 and travels along the rail 410.

The elevating member 300 includes an elevating motor 430 for elevating the guide member 420.

Specifically, when a signal is generated by the controller 500, the elevating motor 430 is operated by the signal, thereby moving the guide member 420 along the rail 410 and the elevating member 300, so that the medical assist devices 2 are dipped into the coating fluid contained in the coating booth 200.

On the other hand, the position adjusting member 400 operated by the driving force of the elevating motor 430 may be replaced with a different moving mechanism such as an LM guide.

The elevating motor 430 may be implemented with a servo motor, a step motor, a DC motor, or an AC motor.

In embodiments, the controller 500 that controls the operation of the position adjusting member 400 is installed on the casing 100.

The controller 500 may control the operation of the position adjusting member 400 according to a setting value entered by an operator.

In embodiments, the coating apparatus further includes coating tubes 600 corresponding to the respective medical assist devices 2 and disposed between the coating booth 200 and the elevating member 300. The inside of each of the coating tubes 400 is coated with a coating fluid, thereby coating the surface of the medical assist device 2 passing therethrough while guiding the medical assist device 2.

The elevating member 300 is positioned in an upper portion of the accommodation space 110 is disposed close to the coating booth 200. The elevating member 300 moves up and down along the rail 410, the medical assist devices 2 also move up and down in conjunction with the elevating member 300.

Since the medical assist device 2 moves up as soon as the medical assist device 2 is coated with the coating fluid in the coating booth 200, the retention time of the medical assist device 2 in the coating booth 200 is minimized.

Therefore, the coating fluid can be uniformly coated on the surface of the medical assist device 2. That is, high quality coating is possible.

The coated medical assist device 2 is dried by a dryer after being transferred to the dryer. Alternatively, the coated medical assist device 2 is dried by an oven installed in the dip coating apparatus 1. The drying step is a final step of the coating process.

In embodiments, the coating tube 600 is provided with an S strap 610 that is bent in an S shape and which functions to temporarily store a coating fluid so that the medical assist device 2 can be easily coated while passing therethrough.

An elevating motor 430 is installed on one side of the elevating member 300 and is connected to the elevating member 300. The elevating motor 430 moves the guide member 420 up and down along the rail 410 so that the elevating member 300 moves up and down.

The apparatus according to embodiments of the present invention configured as described above can reduce the consumption of a coating fluid by using a coating tube, can reduce manufacturing time by using a hopper-shaped coating booth that allows multiple medical assist devices to be coated as a bundle, and can coat a surface of a long medical assist device such as a catheter or guidewire with a coating fluid to a uniform thickness.

It should be understood that the terms used in the specification and the appended claims should not be construed as being limited to general and dictionary meanings, but interpreted based on the meanings and concepts corresponding to technical aspects of the present invention on the basis of the principle that the inventor is allowed to define terms appropriately for the best description of his or her invention.

Accordingly, the configuration illustrated in the embodiments disclosed herein and the drawings is merely embodiments of the present invention, and is not intended to represent all the technical concepts of the present invention, and thereby it should be appreciated that there may exist various equivalents and modifications for substituting those at the time of filing this application.

What is claimed is:

1. A dip coating apparatus for coating surfaces of medical assist devices, the apparatus comprising:

a casing defining an overall external form of the apparatus and providing an accommodation space;

a coating booth provided in a lower portion of the accommodation space and configured to store a coating fluid;

an elevating member provided in the accommodation space, configured to hold an upper end of each of the medical assist devices such that the medical assist devices are hung thereon, and configured to move up and down the medical assist devices;

a position adjusting member installed in the casing and configured to adjust a vertical position of the elevating member; and a controller configured to control operation of the position adjusting member, wherein the coating booth comprises:

a coating unit having the same length as each of the medical assist devices; and a hopper-shaped guide unit disposed over the coating unit and configured to collectively receive and guide a bundle of the medical assist devices to be inserted into the coating unit positioned in a center region of the coating booth, an inner surface of the hopper-shaped guide unit being tapered such that a top of the inner surface is wider than a bottom of the inner surface, in response to bottom end portions of the medical assist devices coming into contact with the tapered inner surface of the hopper-shaped guide unit due to a descending movement of the elevating member, the hopper-shaped guide unit configured to collectively guide the bundle of the medical assist devices along the tapered inner surface thereof such that all of the medical assist devices in the bundle are densely gathered and dipped into the same coating fluid contained in the same coating unit of the coating booth.

2. The apparatus according to claim 1, further comprising one or more coating tubes between the coating booth and the elevating member, the coating tubes having the same length as and respectively connected to the medical assist devices and being coated with the coating fluid on an inner surface thereof such that the respective medical assist devices are coated when the respective medical assist devices pass therethrough.

3. The apparatus according to claim 2, wherein each of the coating tubes is provided with an S-shaped trap that is bent in an S shape and configured to temporarily store the coating fluid so that the coating fluid is coated on a corresponding one of the medical assist devices when the medical assist device passes therethrough.

4. The apparatus according to claim 1, wherein the position adjusting member comprises:

a rail installed to vertically extend in the accommodation space;

a guide member mounted on the elevating member in a manner to move along the rail; and an elevating motor provided on the elevating member and configured to move the guide member in a vertical direction.

5. The apparatus according to claim 1, wherein the elevating member includes a plate equipped with a plurality of clamps configured to hold upper ends of the medical assist devices, and wherein the plate is movable along a longitudinal axis of the position adjusting member.

6. The apparatus according to claim 5, wherein the elevating member is perpendicular to the longitudinal axis of the position adjusting member.

7. The apparatus according to claim 5, wherein the clamps are arranged at regular intervals on the same plate.

8. The apparatus according to claim 1, further comprising a plurality of coating tubes respectively corresponding to the medical assist devices and disposed between the coating booth and the elevating member.

9. The apparatus according to claim 8, wherein an inside of each of the coating tubes is coated with a coating fluid so as to coat the medical assist devices passing therethrough while guiding the medical assist devices.

10. The apparatus according to claim 1, wherein the bottom of the inner surface of the hopper-shaped guide unit is coupled to a top of the coating unit.

* * * * *